US010173308B2

(12) United States Patent
Frischemeier et al.

(10) Patent No.: US 10,173,308 B2
(45) Date of Patent: Jan. 8, 2019

(54) TOOL FOR CRIMPING, PRESSING OR FORMING A WORKPIECE

(71) Applicant: Phoenix Contact GmbH & Co. KG, Blomberg (DE)

(72) Inventors: Jens Frischemeier, Koeterberg-Niese (DE); Danny Siriboe, Hannover (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/574,500

(22) PCT Filed: May 24, 2016

(86) PCT No.: PCT/EP2016/061632
§ 371 (c)(1),
(2) Date: Nov. 16, 2017

(87) PCT Pub. No.: WO2016/193053
PCT Pub. Date: Dec. 8, 2016

(65) Prior Publication Data

US 2018/0126525 A1 May 10, 2018

(30) Foreign Application Priority Data

May 29, 2015 (DE) ..... 10 2015 108 493

(51) Int. Cl.
*B25B 27/10* (2006.01)
*B25B 7/12* (2006.01)
(Continued)

(52) U.S. Cl.
CPC ..... *B25B 27/10* (2013.01); *B25B 7/06* (2013.01); *B25B 7/12* (2013.01); *B25B 27/146* (2013.01); *H01R 43/042* (2013.01)

(58) Field of Classification Search
CPC ..... B25B 27/10; B25B 27/146; B25B 7/12; B25B 7/06; H01R 43/042
(Continued)

(56) References Cited

U.S. PATENT DOCUMENTS 2,991,675 A 7/1961 Ustin
3,226,968 A * 1/1966 Holmes ..... H01R 43/0424 72/31.04
(Continued)

FOREIGN PATENT DOCUMENTS

DE 60120636 T2 10/2006
DE 102009026092 A1 1/2010
(Continued)

OTHER PUBLICATIONS

Thomas Glockseisen und Kurt Battenfeld; Die Bibliothek der Technik Band 342, "Crimptechnik: Herstellung prozesssicherer Verbindungen von elektrischen Leitern und Steckern", Nov. 9, 2012, pp. 58-59.

*Primary Examiner* — David B Jones
(74) *Attorney, Agent, or Firm* — Leydig, Voit & Mayer, Ltd.

(57) ABSTRACT

A tool for crimping, pressing or deforming a workpiece includes a first grip element having a first grip portion; a second grip element having a second grip portion; a mechanism housing, which is arranged on the first grip element and has an end surface facing away from the first grip portion; a tool mechanism, which is enclosed by the mechanism housing and can be actuated to crimp, press or deform the workpiece by adjusting the first and second grip elements relative to one another; and an impact protection element, which is arranged on the first grip demerit and has two limbs and an end face portion, which interconnects the limbs. The mechanism housing is arranged between the limbs, and the
(Continued)

end face portion extends beyond the end surface of the mechanism housing.

14 Claims, 3 Drawing Sheets

(51) Int. Cl.
*B25B 7/06* (2006.01)
*B25B 27/14* (2006.01)
*H01R 43/042* (2006.01)

(58) Field of Classification Search
USPC ..... 72/402
See application file for complete search history.

(56) References Cited

U.S. PATENT DOCUMENTS

| | | | | |
|---|---|---|---|---|
| 5,109,591 | A | 5/1992 | Hung | |
| 6,176,116 | B1 * | 1/2001 | Wilhelm | B25B 27/146 72/402 |
| 2003/0121680 | A1 | 7/2003 | Izumisawa et al. | |
| 2008/0006130 | A1 | 1/2008 | Hsieh | |
| 2011/0094285 | A1 | 4/2011 | Lutze et al. | |
| 2012/0067097 | A1 | 3/2012 | Wagner et al. | |
| 2013/0263705 | A1 | 10/2013 | Broadaway et al. | |
| 2015/0007699 | A1 | 1/2015 | Lee et al. | |
| 2015/0180190 | A1 * | 6/2015 | Dierks | H01R 43/0424 29/751 |

FOREIGN PATENT DOCUMENTS

| | | | |
|---|---|---|---|
| DE | 102009026470 | A1 | 12/2010 |
| EP | 0732779 | B1 | 9/1996 |
| EP | 2562891 | A1 | 2/2013 |
| EP | 2896468 | A2 | 7/2015 |
| FR | 996752 | A | 12/1951 |
| SE | 77765 | C | 1/1930 |

* cited by examiner

TOOL FOR CRIMPING, PRESSING OR FORMING A WORKPIECE

CROSS-REFERENCE TO PRIOR APPLICATIONS

This application is a U.S. National Phase application under 35 U.S.C. § 371 of International Application No. PCT/EP2016/061632, filed on May 24, 2016, and claims benefit to German Patent Application No. DE 10 2015 108 493.7, filed on May 29, 2015. The International Application was published in German on Dec. 8, 2016 as WO 2016/193053 under PCT Article 21(2).

FIELD

The invention relates to a tool for crimping, pressing or deforming a workpiece.

BACKGROUND

A tool of his type comprises a first grip element and a second grip element, which in each case have a grip portion. The grip elements can be adjusted with respect to one another, in particular pivoted with respect to one another, to actuate the tool, in order in this way to actuate a tool mechanism enclosed in a mechanism housing to crimp, press or deform a workpiece inserted in the tool mechanism.

The mechanism housing of the tool mechanism is arranged on the first grip element and has an end surface facing away from the first grip portion of the first grip element. For example, the mechanism housing is arranged on one end of the first grip element extending in an elongate manner and its end surface is therefore remote from the grip portion of the first grip element. The tool may, for example, be configured as pliers, for example as crimping pliers or pressing pliers. The grip elements may be ergonomically designed here, so that a user can grasp the grip elements with one hand in order in this way to manually actuate the tool.

For example, in an embodiment of the tool as crimping pliers, the tool mechanism is to be solidly constructed in such a way that forces occurring during crimping can be advantageously absorbed and deflected. The tool mechanism enclosed in the tool housing therefore has a comparatively great weight, in particular in comparison with the grip elements, which means that the tool can impact the floor particularly with its tool housing if a user drops the tool. If the tool is dropped, damage may therefore occur to the tool housing, for example damage to the surface, which may increase susceptibility to corrosion, or deformation may occur, which in certain cases may impair the functioning of the tool.

Tools for crimping, pressing or deforming a workpiece are known, for example, from EP 0 732 779 B1 and the Swedish patent application, not previously published, with the application number SE 77765, the content of which is to be incorporated in its entirety in the present specification.

In the case of pressing pliers for wire end ferrules known from EP 0 732 779 B1, the pressing jaws of a pressing tool can be adjusted with respect to one another, for example by pivoting grip elements with respect to one another, so that a working space formed between the pressing jaws is reduced and a workpiece in the form of a wire end ferrule is pressed in the working space.

There is a need for a tool, which is protected in a better manner on impact, for example when the tool is dropped on the floor.

SUMMARY

In an embodiment, the present invention provides a tool for crimping, pressing or deforming a workpiece, comprising: a first grip element having a first grip portion; a second grip element having a second grip portion; a mechanism housing, which is arranged on the first grip element and has an end surface facing away from the first grip portion; a tool mechanism, which is enclosed by the mechanism housing and is configured to be actuated to crimp, press or deform the workpiece by adjusting the first and second grip elements relative to one another; and an impact protection element, which is arranged on the first grip element and has two limbs and an end face portion, which interconnects the limbs, wherein the mechanism housing is arranged between the limbs, and the end face portion extends beyond the end surface of the mechanism housing.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
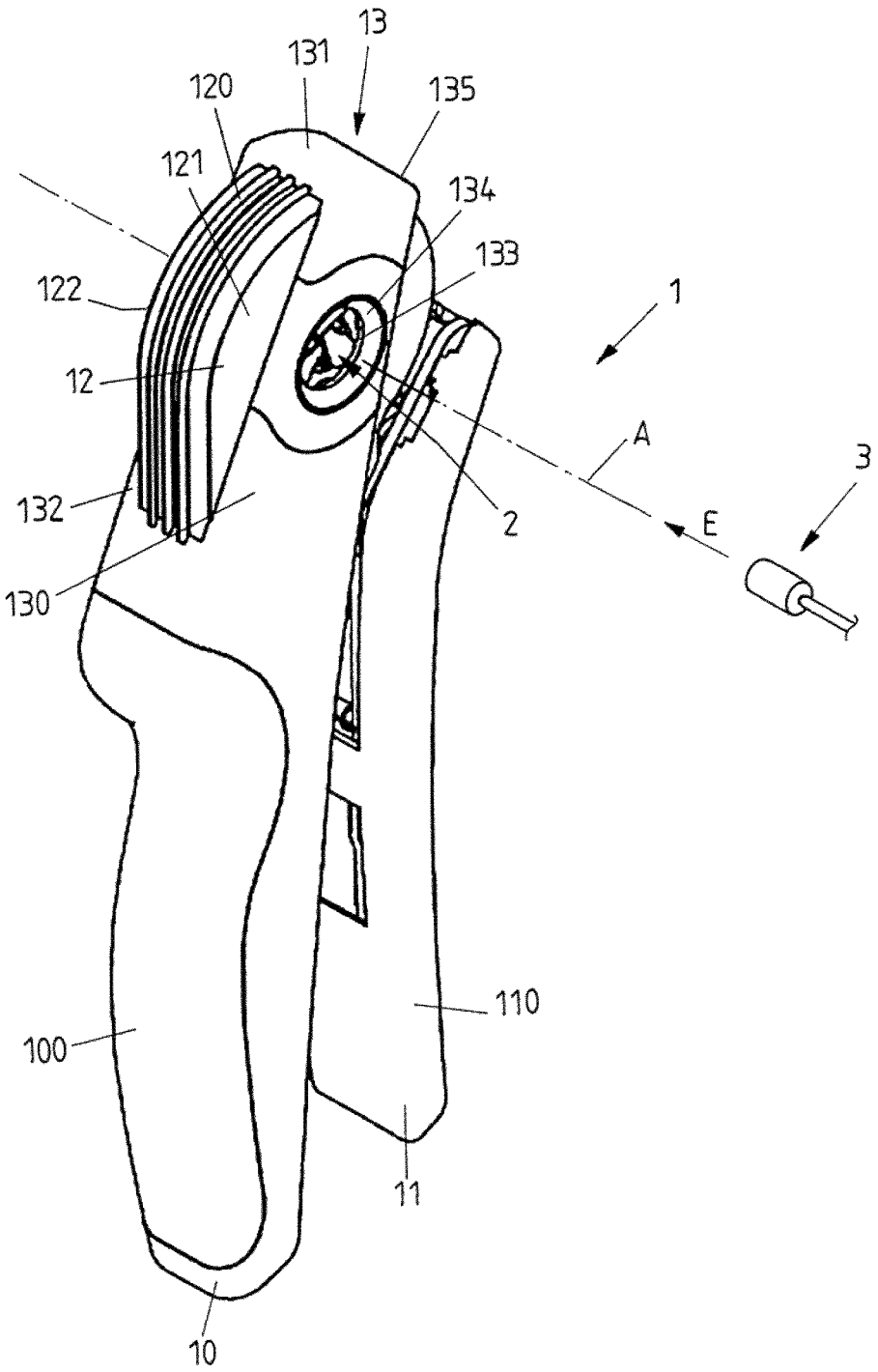
FIG. 1 is a perspective view of a tool for crimping, pressing or deforming a workpiece.

An aspect of the invention provides a tool for crimping, pressing or deforming a workpiece, which provides improved impact protection in a simple, cost-effective manner.

In an embodiment, the tool has an impact protection element, which is arranged on the first grip element and has two limbs and an end face portion connecting the limbs to one another, the mechanism housing being arranged between the limbs and the end face portion extending beyond the end surface of the mechanism housing.

The impact protection element, with its end face portion, covers the end surface of the mechanism housing, at least in portions. The end surface of the mechanism housing faces away from the grip portion of the first grip element and is particularly susceptible to damage when the tool is dropped because, due to the comparatively heavy tool mechanism, the impact of the tool tends, in particular, to be on this end surface. Since the end surface is covered at least in part by the end face portion of the impact protection element, the end face portion can cushion an impact and therefore protect the mechanism housing at its end surface, so that the danger of damage to the mechanism housing is at least reduced.

The impact protection element may, for example, be configured as a U-shaped bow. The impact protection element extends from the first grip element and encloses the mechanism housing at least in part. For example, the limbs of the bow-shaped impact protection element may extend along the side surfaces of the mechanism housing and therefore protect the mechanism housing on said side surfaces, while the end face portion interconnects the limbs and covers the end surface of the mechanism housing, so that protection is provided at the end surface by the end face portion.

The grip elements of the tool can preferably be pivoted with respect to one another about a pivot axis in order to actuate the tool mechanism of the tool for crimping, pressing or deforming a workpiece inserted into the tool mechanism. The mechanism housing has, for example, side surfaces, which are spaced apart from one another along the pivot axis and are interconnected by the end surface, which is curved about the pivot axis, for example. The end face portion of the impact protection element extends parallel to the pivot axis beyond the end surface and therefore covers the end surface outwardly at least in part, so that the mechanism housing is outwardly protected in the event of an impact by the end face portion of the impact protection element.

The end surface of the mechanism housing may, for example, be curved in the form of a circular arc, at least in portions, about the pivot axis.

The end face portion of the impact protection element outwardly covers, at least in part, the end surface of the mechanism housing and therefore provides impact protection for the mechanism housing on its end surface. By means of the end face portion, protection may be provided here for the end surface of the mechanism housing, not only in the direct overlap region, but in general all such regions of the end surface are protected, which due to the shaping of the end face portion cannot come into contact with the surface, on which the tool impacts, in the event of an impact of the tool. If the end face portion of the impact protection element, for example, forms a first impact edge, which is arranged with respect to a second impact edge of the first grip element or of the second grip element in such a way that the mechanism housing is set back in relation to an imaginary line interconnecting the first impact edge and the second impact edge, the tool is intercepted by the two impact edges and cannot impact with the mechanism housing set back in relation to the impact edges, in other words the set-back regions of the mechanism housing arranged between the impact edges, so that the mechanism housing is additionally protected by the impact edges.

The first grip element, just like the second grip element, may be manufactured from plastics material, for example, wherein two-component technology, for example, can be used for production in order, for example, to produce the grip portion, on the one hand, and other portions of the grip element, on the other hand, from different plastics materials having different rigidity. The impact protection element is preferably formed integrally, in other words in one piece, with the first grip element, also from plastics material, the impact protection element, starting from the first grip element, extending beyond the mechanism housing and therefore enclosing said mechanism housing at least in part.

In contrast, the mechanism housing is manufactured from metal, for example, and therefore has an increased structural strength, which is necessary in order to be able to suitably absorb and deflect the forces occurring in the tool mechanism. For example, the mechanism housing may be manufactured from steel.

To be able to crimp, press or otherwise deform a workpiece, for example a sleeve or the like, the workpiece is to be inserted, for example, into a working space of the tool mechanism. For this purpose, one or both limbs of the impact protection element may have an opening, which is, for example, coaxial with the pivot axis of the grip elements and allows a workpiece to be inserted into the working space of the tool mechanism.

In order to further simplify insertion of the workpiece into the tool mechanism, a lead-in chamfer may, for example, be arranged on an edge surrounding the opening, onto which chamfer the workpiece runs upon insertion into the tool mechanism, so that the workpiece is guided in a favorable, simple manner into the working space of the tool mechanism by means of the lead-in chamfer.

The tool mechanism may, for example, be configured as described in EP 0 732 779 B1 or in the Swedish patent application, not previously published, having the application number SE 77765, the content of which is incorporated in its entirety into this specification.

For example, the tool mechanism may have an adjusting element and at least one pressing element movably arranged on the adjusting element, it being possible for the adjusting element to be actuated to move the pressing element by adjusting the first and second grip elements relative to one another. The adjusting element may, for example, be rotatable about the pivot axis of the grip elements in the mechanism housing through a predetermined angle to thus adjust one or more pressing elements coupled to the adjusting element, in such a way that a working space formed in the tool mechanism is reduced and therefore a workpiece inserted in the working space is pressed, for example crimped. If a plurality of pressing elements are provided, these are preferably uniformly adjusted by adjusting the adjusting element and act on the workpiece from different sides, so that the workpiece is deformed in a similar manner on different sides.

Figure 2:
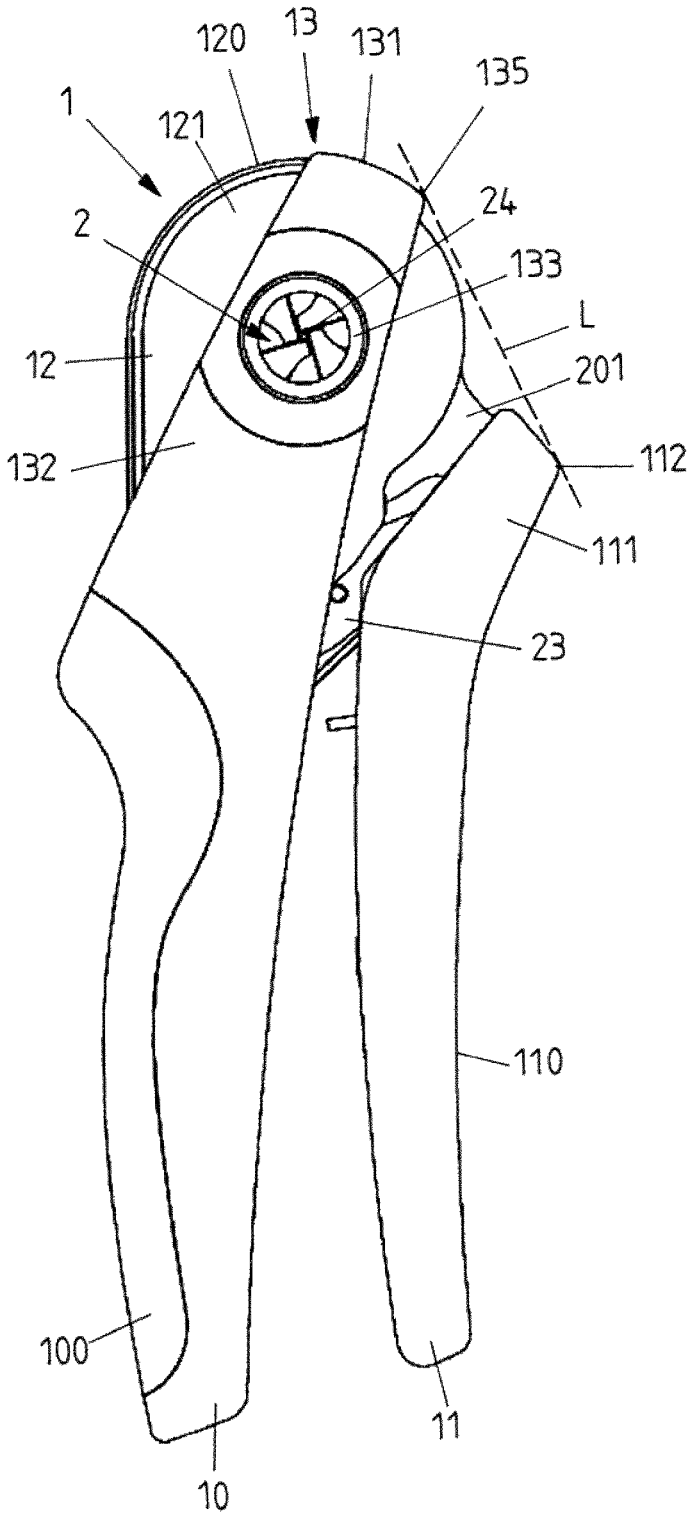
FIG. 2 is a side view of the tool.

FIGS. 1 and 2 show a tool 1, which is configured as crimping pliers in the embodiment shown. The tool 1 has a first grip element 10 and a second grip element 11, which can be pivoted with respect to one another about a pivot axis A and can be actuated to crimp a workpiece 3, for example a sleeve on an electrical cable.

The grip elements 10, 11 are in each case manufactured from plastics material, for example by means of two-component technology, e.g. by means of plastics material injection molding and in each case have a grip portion 100, 110, which, compared to other portions of the respective grip element 10, 11, can be manufactured from another material, for example a material which is softer, to allow an ergonomically favorable, haptically pleasant gripping of the grip elements 10, 11 by a user.

A tool mechanism 2, which can be mechanically actuated by adjusting the grip elements 10, 11 with respect to one another and is enclosed in a mechanism housing 12, is arranged at a front end of the first grip element 10. The mechanism housing 12 can, for example, be produced from metal, in particular steel.

Because the tool mechanism 2 and also the mechanism housing 12 have to absorb relatively large forces to deform the workpiece 3 when the tool 1 is actuated, the tool mechanism 2, just like the mechanism housing 12, is configured comparatively solidly with a high structural strength. The tool mechanism 2 and the mechanism housing 12 are therefore comparatively heavy compared to the grip elements 10, 11.

This means that the tool 1, when a user accidentally drops it, will tend to impact with the mechanism housing 12, which can lead to damage to the mechanism housing 12 and also to the tool mechanism 2.

The mechanism housing 12 has two side surfaces 121, 122, which are spaced apart from one another along the pivot axis A, in each case extend transversely to the pivot axis A and are interconnected by an end surface 120, so that an outwardly closed mechanism housing 12 is produced. There is an increased danger of an impact, in particular on portions of the end surface 120 remote from the grip element 10 when the tool 1 firstly impacts a floor, for example, with the mechanism housing 12.

In order to provide impact protection for the tool 1, an impact protection element 13, which extends in the form of a U-shaped bow from the first grip element 10 and encloses the mechanism housing 12 at least in part, is arranged on the first grip element 10. The impact protection element 13 has two lateral limbs 130, 132, which extend along the side surfaces 121, 122 of the mechanism housing 12 and are interconnected by an end face portion 131 covering the end surface 120.

The impact protection element 13 is manufactured integrally with the first grip element 10 and consists, like the grip element 10, of plastics material.

Since the impact protection element 13, in particular with its end face portion 131, covers the end surface 120 of the mechanism housing 12 on a side of the mechanism housing 12 facing away from the grip element 10, the mechanism housing 12 is protected in the event of an impact, in particular in the region of its end surface 120. In addition, protection is provided on the side surfaces 121, 122 of the mechanism housing 12 by means of the limbs 130, 132.

Since the impact protection element 13 is manufactured integrally with the first grip element 10 from plastics material and therefore—in comparison with the metal mechanism housing 12—consists of a soft material, forces acting in the event of the impact are effectively damped so that the danger of damage to the mechanism housing 12 is reduced.

The impact protection element 13, with its end face portion 131, viewed in the peripheral direction about the pivot axis A, provides protection in this case not only in the direct overlap region of the end surface 120, but also in those regions, in which contact is prevented during the impact, as shown in FIG. 2. Thus, the end face portion 131 is configured as a first impact edge 135, which, together with a second impact edge 112 at an end of the second grip element 11 facing the tool mechanism 2, provides additional impact protection. Because the mechanism housing 12 is set back in relation to an imaginary line L interconnecting the impact edge at 135, 112, as can be seen in FIG. 2, an impact can be absorbed by means of the impact edge 135, 112 without the mechanism housing 12 being able to come into contact with a surface, on which the tool 1 impacts, with its portions located between the impact edges 135, 112. Protection is therefore also provided via the impact protection element 13 in the regions of the mechanism housing 12 located between the impact edges 135, 112.

To process a workpiece 3, for example a crimping sleeve, the workpiece 3 is inserted into the tool mechanism 2 in an insertion direction E. The tool mechanism 2 is enclosed within the mechanism housing 12 and is accessible here via an opening 133 in the limb 130, so that the workpiece 3 can be inserted into the tool mechanism 2 through the opening 133 (an identical opening can also be provided on the other opposing limb 132, so that the workpiece 3 can be inserted into the tool mechanism 2 from both sides).

A peripheral lead-in chamfer 134 placed obliquely relative to the insertion direction E is provided on the opening 133 and facilitates insertion of a workpiece 3 into the opening 133 and, in particular, guides the workpiece 3 into the tool mechanism 2 during insertion.

Figure 3A:
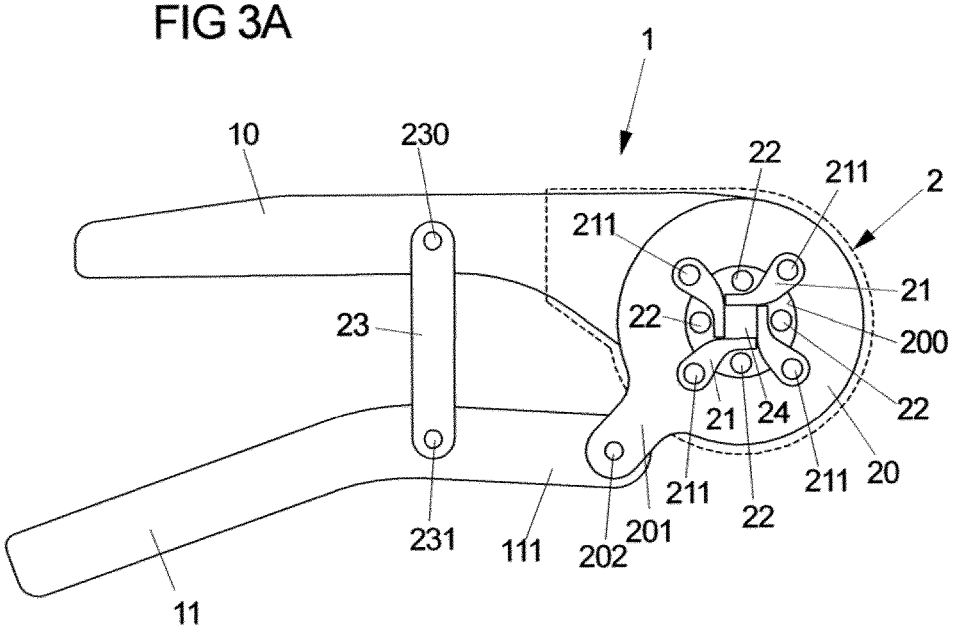
FIG. 3A is a schematic view of an embodiment of a tool mechanism of the tool before the tool is actuated to deform a workpiece.
Figure 3B:
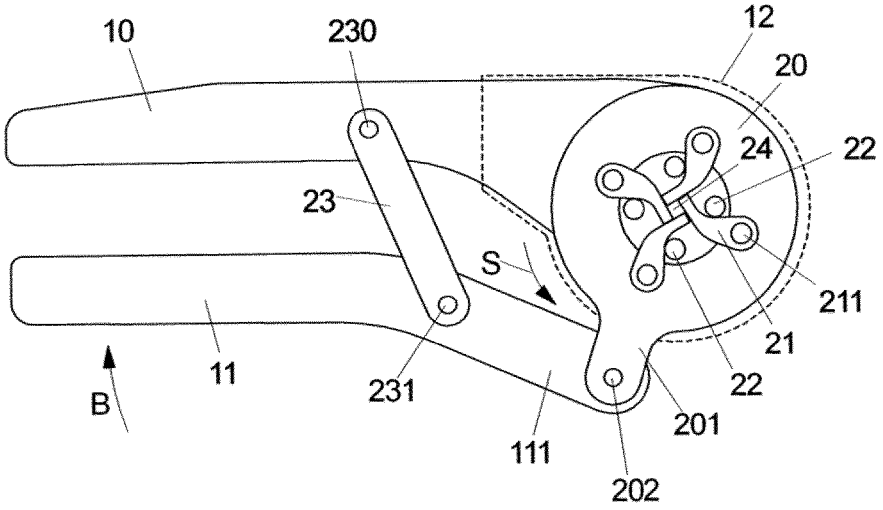
FIG. 3B is a schematic view of the tool mechanism after actuation to deform a workpiece.

One embodiment of a tool mechanism 2 is shown schematically in FIGS. 3A and 3B, wherein FIG. 3A shows the tool mechanism 2 before the tool 1 is actuated to deform the workpiece 3 and FIG. 3B shows the tool 1 after actuation.

In the embodiment shown, the tool mechanism 2 has an adjusting element 20, which is pivotably mounted about the pivot axis A in the mechanism housing 12 and is coupled to the second grip element 11 by a pivot point 202 on a tab element 201. A plurality of pressing elements 21 (four in the embodiment shown) are arranged on the adjusting element 20, each pressing element 21 being pivotable about an associated pivot point 211 with respect to the adjusting element 21, at least by a specific pivoting path.

The pressing elements 21 are arranged with their pivot points 211 equally spaced apart about the pivot axis A on the adjusting element 20.

The tool mechanism 2 further has a plurality of guide journals 22, which are in each case associated with a pressing element 21 and are fixed and stationary with respect to the first grip element 10. The guide journals 22 engage through an opening 200 in the adjusting element 20 and in each case guidingly abut an associated pressing element 21.

The pressing elements 21 between them form a working space 24, in which a workpiece 3 can be inserted and the size of which is variable in order in this way to deform a workpiece 3 inserted into the working space 24. When the tool 1 is in a non-actuated state (FIG. 3A), the working space is comparatively large with respect to its cross-sectional area (perpendicular to the pivot axis A in the pivoting plane). On the other hand, after actuation of the tool 1 (FIG. 3B), the size of the working space 24 is reduced, so that a workpiece 3 located in the working space 24 is pressed.

The second grip element 11 is additionally coupled via a lever element 23 to the first grip element 10, the lever element 23 being pivotably connected by means of pivot points 230, 231 to the first grip element 10, on the one hand, and to the second grip element 11, on the other hand.

To actuate the tool 1, the second grip element 11 is pivoted in an actuating direction B (see FIG. 3B) relative to the first grip element 10 and is therefore moved closer to the first grip element 10. As a result, guided by the lever element 23, the adjusting element 20 is adjusted in a pivoting direction S within the mechanism housing 12, so that the pressing elements 21, due to the interaction with the guide journals 23, are moved with respect to one another to reduce the working space 24. A workpiece 3 located in the working space 24 is therefore deformed, for example crimped.

For further details of the mode of functioning of a tool mechanism 2 of this type, reference is also made to the Swedish patent application, not previously published, with the application number SE 77765.

It is also expressly pointed out that the tool mechanism 2 can basically also be configured completely differently. To this extent, the embodiment described with the aid of FIGS. 3A and 3B is purely used for illustration.

The idea on which the invention is based is not limited to the embodiments described above, but can also basically be implemented in a completely different manner.

A tool of the type described here may, in particular, be configured as crimping pliers or pressing pliers and be used for crimping or pressing workpieces, for example sleeves such as wire end ferrules or the like.

Because damage to a mechanism housing can be reliably prevented by an impact protection element of the type described, in particular the danger of corrosion on the mechanism housing as a result of damage can be reduced.

In addition, deformations on the mechanism housing as a result of being dropped and limitations to the functionality of the tool associated with this can be avoided.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 tool
10 grip element
100 grip portion
11 grip element
110 grip portion
111 end
112 impact edge
12 mechanism housing
120 end surface
121, 122 side surfaces
13 impact protection element (bow)
130 limb
131 end face portion
132 limb
133 opening
134 lead-in chamfer
135 impact edge
2 tool mechanism
20 adjusting element
200 opening
201 tab element
202 pivot point
21 pressing element
211 pivot point
22 guide journal
23 lever element
230, 231 pivot point
24 working space
3 workpiece
B actuating direction
E insertion direction
L line
S pivoting direction

The invention claimed is:

1. A tool for crimping, pressing or deforming a workpiece, comprising:

a first grip element having a first grip portion;

a second grip element having a second grip portion;

a mechanism housing, which is arranged on the first grip element and has an end surface facing away from the first grip portion;

a tool mechanism, which is enclosed by the mechanism housing and is connected to the second grip element so as to be actuable to crimp, press, or deform the workpiece by pivoting the first and second grip elements relative to one another about a pivot axis passing perpendicularly through the tool mechanism; and an impact protection element, which is arranged on the first grip element and has two limbs and an end face portion, which interconnects the limbs, wherein the mechanism housing is arranged between the limbs, and the end face portion extends beyond the end surface of the mechanism housing.

2. The tool according to claim 1, wherein the impact protection element is U-shaped.

3. The tool according to claim 1, wherein the end face portion extends parallel to the pivot axis beyond the end surface of the mechanism housing.

4. The tool according to claim 3, wherein the limbs of the impact protection element extend along opposing side surfaces of the mechanism housing, which are spaced apart from one another along the pivot axis.

5. The tool according to claim 3, wherein the end surface of the mechanism housing includes a portion that is curved in the form of a circular arc about the pivot axis.

6. The tool according to claim 1, wherein the end face portion of the impact protection element has a first impact edge, which is arranged with respect to a second impact edge of the first grip element in such a way that the mechanism housing is set back in relation to an imaginary line interconnecting the first impact edge and the second impact edge.

7. The tool according to claim 1, wherein the first grip element is comprised of plastics material.

8. The tool according to claim 1, wherein the impact protection element together with the first grip element are comprised of plastics material.

9. The tool according to claim 1, wherein the mechanism housing is comprised of metal.

10. The tool according to claim 1, wherein at least one of the limbs has an opening configured to introduce the workpiece into a working space of the tool mechanism.

11. The tool according to claim 10, wherein the opening comprises a lead-in chamfer.

12. The tool according to claim 1, wherein the tool mechanism has an adjusting element and at least one pressing element movably arranged on the adjusting element, wherein the adjusting element is pivotably mounted in the mechanism housing, and wherein the adjusting element is configured to be actuated to move the pressing element by adjusting the first and second grip elements relative to one another.

13. The tool according to claim 12, wherein the at least one pressing element is configured to be moved to crimp, press, or deform the workpiece by pivoting the adjusting element.

14. The tool according to claim 1, wherein the end face portion of the impact protection element has a first impact edge, which is arranged with respect to a second impact edge of the second grip element in such a way that the mechanism housing is set back in relation to an imaginary line interconnecting the first impact edge and the second impact edge.

* * * * *